US005648646A

United States Patent [19]

Flegel

[11] Patent Number: 5,648,646

[45] Date of Patent: Jul. 15, 1997

[54] CIRCUIT BREAKER LINKAGE ASSEMBLY

[75] Inventor: David D. Flegel, Racine, Wis.

[73] Assignee: Reliance Time Controls, Inc., Racine, Wis.

[21] Appl. No.: 491,794

[22] Filed: Jun. 19, 1995

[51] Int. Cl.[6] ..... H01H 33/52

[52] U.S. Cl. ..... 200/50.32; 200/50.4; 335/8

[58] Field of Search ..... 200/50.01, 50.32, 200/50.33, 50.35, 50.37, 50.4; 335/159–161, 7–10

[56] References Cited

U.S. PATENT DOCUMENTS

| | | | |
|---|---|---|---|
| 3,158,701 | 11/1964 | Nadeau | 200/50 |
| 3,198,898 | 8/1965 | Piteo, Jr. | 200/50 |
| 3,647,997 | 3/1972 | Nerem | 200/50 C |
| 3,705,280 | 12/1972 | Harms | 200/50 |
| 3,778,633 | 12/1973 | DeVisser et al. | 307/64 |
| 4,270,031 | 5/1981 | Borona et al. | 200/50 |
| 4,510,357 | 4/1985 | Winterbottom | 200/50 R |
| 4,665,284 | 5/1987 | Guinan | 200/50 |
| 4,902,859 | 2/1990 | Witzmann et al. | 200/50 |
| 4,906,958 | 3/1990 | Adamson | 335/11 |
| 4,924,041 | 5/1990 | Yee | 200/50 |
| 4,980,525 | 12/1990 | Kakisako | 200/50 |
| 5,008,499 | 4/1991 | Yee et al. | 200/50 |
| 5,109,142 | 4/1992 | von Kannewurff et al. | 200/50 |
| 5,122,624 | 6/1992 | Benda | 200/43.14 |
| 5,172,087 | 12/1992 | Castonguay et al. | 335/160 |
| 5,189,385 | 2/1993 | Gnahn | 335/132 |
| 5,268,543 | 12/1993 | Ramos | 200/43.11 |
| 5,270,503 | 12/1993 | Frye | 200/43.14 |
| 5,310,969 | 5/1994 | Turek et al. | 200/43.14 |
| 5,322,980 | 6/1994 | Benda | 200/43.014 |

*Primary Examiner*—Michael L. Gellner
*Assistant Examiner*—Michael A. Friedhofer
*Attorney, Agent, or Firm*—Andrus, Sceales, Starke & Sawall

[57] ABSTRACT

An interlock for first and second tandemly aligned circuit breaker switches which respectively have first and second external operating handles thereon oriented such that the operating handles are disposed away from each other when the switches are OFF and towards each other when the switches are ON. The interlock includes a linkage arrangement formed with at least one slot and having one end connected to the first operating handle and another end connected to the second operating handle such that pushing the first operating handle from an OFF to an ON position pushes the second operating handle from an ON to an OFF position.

10 Claims, 4 Drawing Sheets

FIG. 11
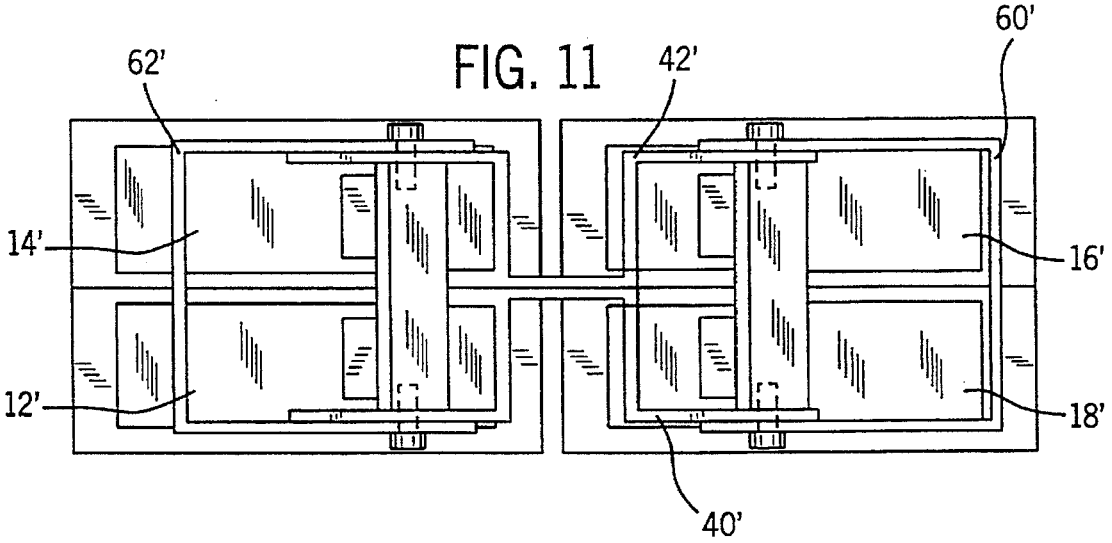
FIG. 12
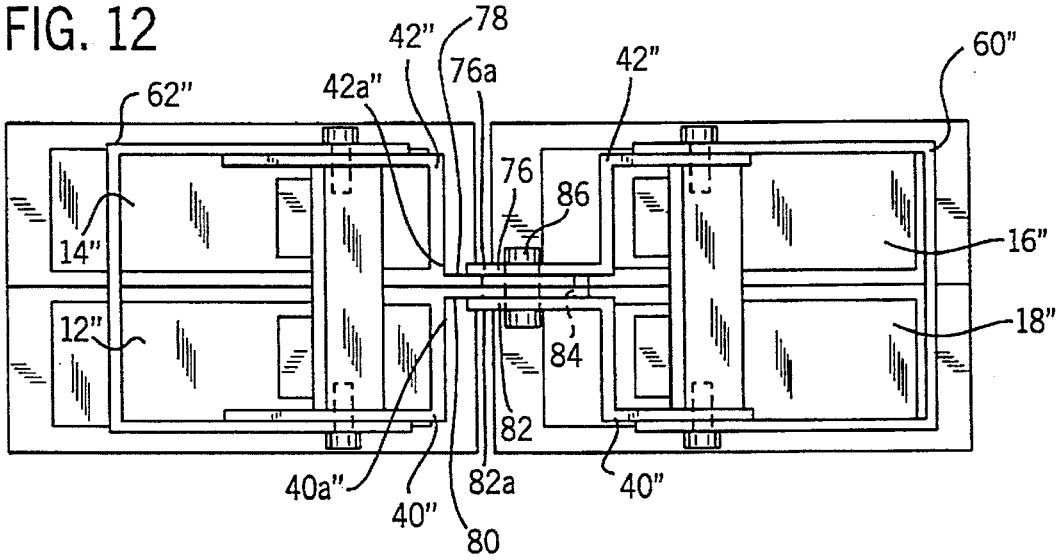
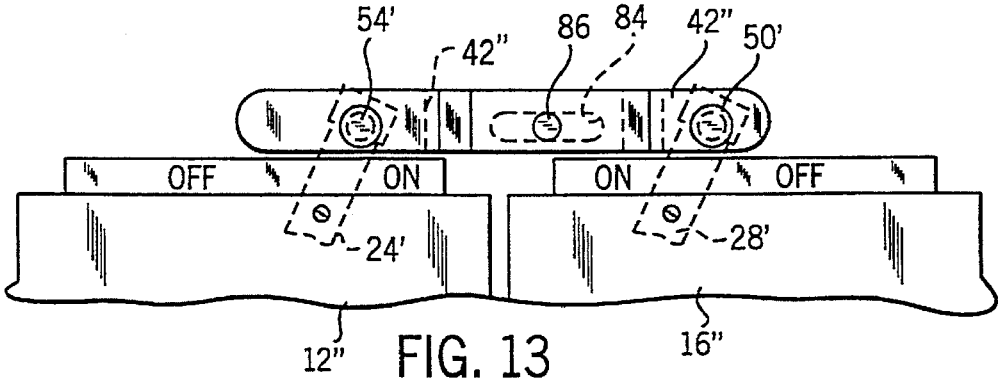
FIG. 13

CIRCUIT BREAKER LINKAGE ASSEMBLY

FIELD OF THE INVENTION

This invention is generally related to an interlock for circuit breaker switches and, more particularly, pertains to a circuit breaker linkage assembly interlocking two opposing circuit breaker handles and preventing both circuit breakers from being ON at the same time.

BACKGROUND OF THE INVENTION

In today's electrical supply systems, there are occasions when alternate sources of electric power are necessary or desirable. For example, the capability of switching from utility power to emergency generator power is extremely important for many businesses, hospitals and industries, and is also being employed in residential applications.

In certain applications, it is desirable for separate electrical circuits or even separate groups of electrical circuits to be arranged so that when one group of circuits is switched to a conductive state, another group of circuits is switched to a non-conductive state in alternating fashion. In some arrangements, it may be desirable to alternately switch a common load between separate power sources so that as one power source is disconnected from the load, the second power source is simultaneously connected to prevent any or minimal interruption of power to the load. In order that the desired period of alternate switching may be effective essentially simultaneously, a need has been recognized to employ a coupling mechanism which functions to switch one group of circuits OFF as the other group of circuits is switched ON.

It remains desirable to provide a mechanism which automatically turns one circuit breaker OFF when an adjacent circuit breaker is turned ON. Such a mechanism should assure that the main contacts of both circuit breakers cannot be closed at the same time. It is also desirable that the mechanism does permit, however, both of the circuit breakers to be switched OFF at the same time.

SUMMARY OF THE INVENTION

The present invention advantageously provides an improved interlock for circuit breakers installed in a standard load center for the specific purpose of providing a safe and simple arrangement for providing power to the selected circuits from an alternate power source, such as a portable generator, during a utility power outage. The present invention enables the use of standard, off-the-shelf circuit breakers which may be retrofitted without extensive modification of the circuit breaker.

In one aspect of the invention, there is provided an interlock for first and second tandemly aligned circuit breaker switches respectively having first and second external operating handles thereon oriented such that the operating handles are disposed away from each other when the switches are OFF and towards each other when the switches are ON. The interlock comprises a linkage arrangement disposed across the face of the circuit breaker switches for applying a linear force between the first operating handle and the second operating handle. The linkage arrangement is formed with at least one slot and has one end connected to the first operating handle and another end connected to the second operating handle such that pushing the first operating handle from an OFF to an ON position pushes the second operating handle from an ON to an OFF position. In the preferred embodiment, the linkage arrangement has an aperture at one end and a slot at the other end, the slot having a leading edge and a trailing edge, there being a first pin passing through the aperture and insertable in a side of the first operating handle and a second pin passing through the slot and insertable in a side of the second operating handle.

In another aspect of the invention, the linkage arrangement has a first slot at one end and a second slot at the other end, each of the first and second slots having a leading edge and a trailing edge, there being a first pin passing through the first slot and insertable in a side of the first operating handle and a second pin passing though the second slot and insertable in a side of the second operating handle.

In yet a further aspect of the invention, the linkage arrangement has a first aperture at one end, a second aperture at the other end, and a slot having a leading edge and trailing edge midway between the one end and the other end, there being a first pin passing through the first aperture and insertable in a side of the first operating handle, a second pin passing through the second aperture and insertable in a side of the second operating handle, and a third pin passing through and retained within the slot.

In yet another aspect of the invention, the interlock includes a fastener arrangement for connecting the linkage arrangement to the first operating handle and the second operating handle. Also included are retainer brackets, portions of which are disposed alongside the linkage arrangement for holding and aligning the fastener arrangement.

In yet another aspect of the invention, there is contemplated an interlock for first, second, third and fourth circuit breakers having respective first, second, third, and fourth external operating handles, the first and third switches being laterally aligned and the second and fourth switches being laterally aligned, the first and second switches being tandemly aligned and the third and fourth switches being tandemly aligned, the operating handles of the first and third switches being joined together and the operating handles of the second and fourth switches being joined together. The joined operating handles of the first and third switches are disposed away from the joined operating handles of the second and fourth switches when the switches are in the OFF position. The joined operating handles of the first and third switches are disposed towards the joined operating handles of the second and fourth switches when the switches are in the ON position. The interlock comprises a pair of parallel, elongated, planar links, each of the links having one end formed with an opening and connected in fixed relationship to a respective side of the joined first and third operating handles. Each of the links further has another end formed with a slot and connected in slotted relationship to a respective side of the joined second and fourth handles such that pushing the operating handles of the joined first and third switches from an OFF to an ON position pushes the operating handles of the joined second and fourth switches from an ON to an OFF position. Each side of the joined first and third operating handles and the joined second and fourth operating handles is provided with a bore therein. A pair of U-shaped retainer members is included, each retainer member having parallel side arms disposed outside of the links and formed with threaded apertures adapted to be aligned respectively with the openings in the links and the bores in the sides of the joined first and third operating handles, and with the slots in the links and the bores in the sides of the joined second and fourth operating handles. A first pin is screwthreaded into one of the threaded apertures and passes through one of the openings into said bore on one side of the joined first and third operating handles. A second pin is screwthreaded into one of the threaded apertures and passes through one of the slots into the bore on one side of the joined second and fourth operating handles. A third pin is screwthreaded into one of the threaded apertures and passes through the other of the slots into the bore on the other side of the joined second and fourth operating handles. A fourth pin is screwthreaded into one of the threaded apertures and passes through one of the openings on the other side of the joined first and third operating handles.

BRIEF DESCRIPTION OF THE DRAWINGS

The invention will become better understood by reference to the following detailed description of the preferred exemplary embodiment when read in conjunction with the appended drawing wherein like numerals denote like elements.

FIG. 11 is a top view of the first alternative embodiment of the invention;

FIG. 12 is a top view of a second alternative embodiment of the invention; and FIG. 13 is a front elevational view of the linkage shown in FIG. 12.

DETAILED DESCRIPTION OF THE PREFERRED EMBODIMENT

Figure 1:
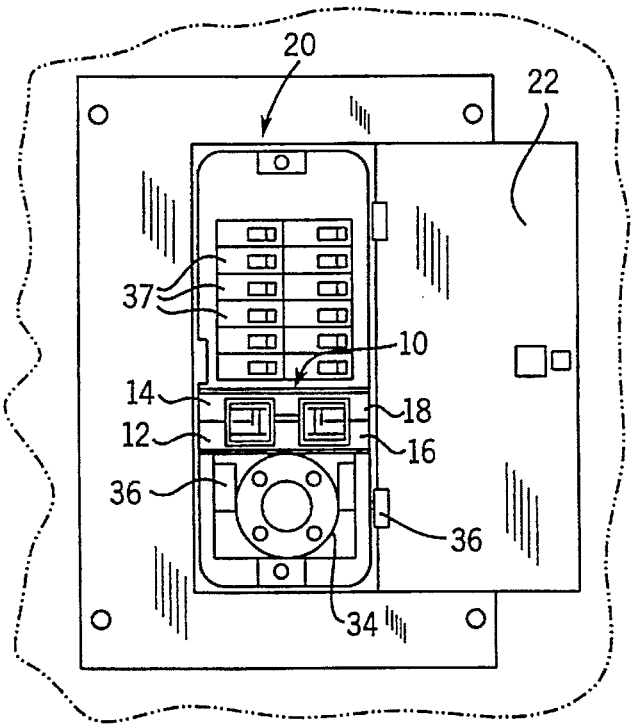
FIG. 1 is a front elevational view of a load center panel having an array of opposed circuit breakers, at least one pair of which is interconnected by the linkage embodying the present invention.
Figure 2:
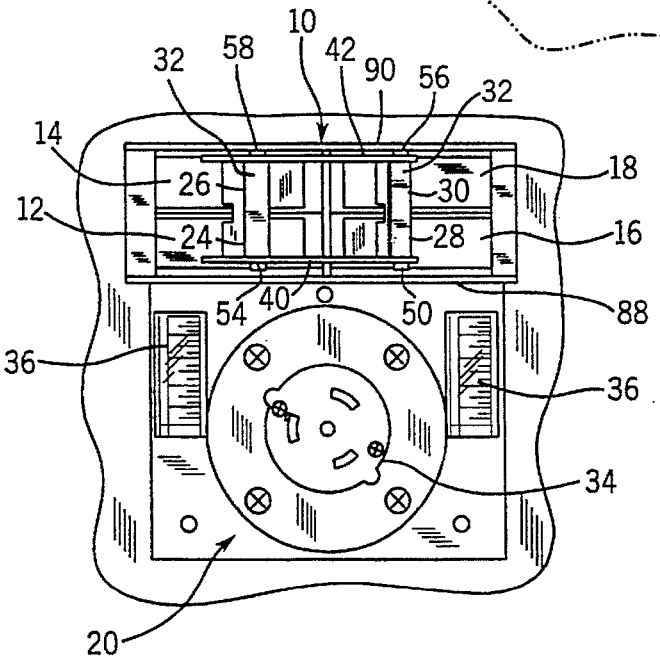
FIG. 2 is an enlarged, front elevational view of the lower portion of the load center panel of FIG. 1.

The preferred embodiment of the inventive interlock of circuit breaker switches is generally identified in FIGS. 1–10 by the reference numeral 10 and is shown in connection with circuit breaker switches 12, 14, 16 and 18. The circuit breaker switches depicted in the drawings are standard, commercially available electrical mechanisms of the type manufactured by the ITE Circuit Protection Division of Siemens Energy and Automation Inc. They are further identified by the manufacturers as type QP, double pole. Such circuit breaker switches are conveniently snapped into a conventional load center panel 20 provided with a hinged door 22 and beneath which panel are positioned paneled buses. It is the usual design for circuit breaker switches of this type to have spring biased, over-the-center operating handles such as 24, 26, 28 and 30, In normal operations, these handles are employed to manually ON and OFF switch the circuit control by that switch. Normally, such switches are designed such that when the electrical device is ON switched and a current overload occurs, the internal mechanism causes the device to OFF switch. Thus, both switching functions are combined in a single unit.

It is standard to mount a pair of circuit breaker switches such as 12 and 14, and 16 and 18, in laterally adjacent pairs so that they may be interconnected or ganged together. In the particular switches shown, ganging of a pair of switches is obtained by a tie bar or cap 32 which bridges operating handles 24 and 26, and 28 and 30. It should be understood, however, that such operating handles may be unitarily formed together or otherwise joined. In addition, switches 12 and 16, and 14 and 18 are stacked one on top of the other in opposed relationship such that the switches are also tandemly aligned. In the preferred embodiment to follow, it will be assumed that the switches 12 and 14 are fed from power from an electrical utility and the switches 16 and 18 are fed by an alternate power source such as a portable power generator. The bottom portion of load center panel 20 may include a power inlet 34 for the generator and wattage meters 36 for monitoring current draw from the generator. Other utility-side circuit breaker switches 37 and opposed generator-side switches are available along the paneled bus to feed branch circuits intended to be fully operational during a utility power outage by use of interlocks (not shown) such as 10 for interconnecting such switches. Tandemly aligned circuit breaker switches 12 and 16, and 14 and 18 are oriented such that the operating handles 24 and 26, and 28 and 30 are positioned away from each other when the switches are OFF and are oriented towards each other when the switches are ON.

As a salient feature of the invention, circuit breaker switches are provided with the interlock 10 for providing the switches from simultaneously feeding the panel bus and each other. Otherwise stated, interlock 10 of the present invention ensures that a pair of circuit breaker switches mounted in opposed orientation with their operating handles mechanically interconnected will be mutually constrained so that only one of the circuit breaker switches can be in the ON position at any one time. While the interlock 10 prohibits both circuit switches from being ON at the same time, it does allow both circuit breaker switches to be in the OFF position simultaneously as well, as will be appreciated hereafter.

Interlock 10 comprises a linkage arrangement disposed across the face 38 of the circuit breaker switches 12, 14, 16 and 18 for applying a linear force between operating handles 24, 26, 28 and 30. More particularly, the preferred linkage arrangement includes a pair of parallel, elongated, straight metallic links 40, 42, each of which lies in a plane perpendicular to the face 38 of circuit breaker switches 12, 14, 16 and 18. For simplicity, only the link 40 for switches 12 and 16 will be described in detail, it being understood that link 42 for switches 14 and 18 is identical in all aspects to link 40 and that switches 12 and 14, and 16 and 18 are tied together as previously described. Link 40 has an aperture 43 formed at one end and an elongated slot 44 at the other end, slot 44 having a leading edge 46 and a trailing edge 48. A first pin 50 passes through aperture 43 and is insertable in a conventional bore formed on one side of operating handle 28. A second pin 54 passes through slot 44 and is insertable in a conventional bore formed on one side of operating handle 24. The distance between aperture 43 and slot 44 is a predetermined value such that trailing edge 48 of slot 44 acting against pin 54 forces operating handle 24 over center to the OFF position before operating handle 28 reaches the ON position.

Figure 10:
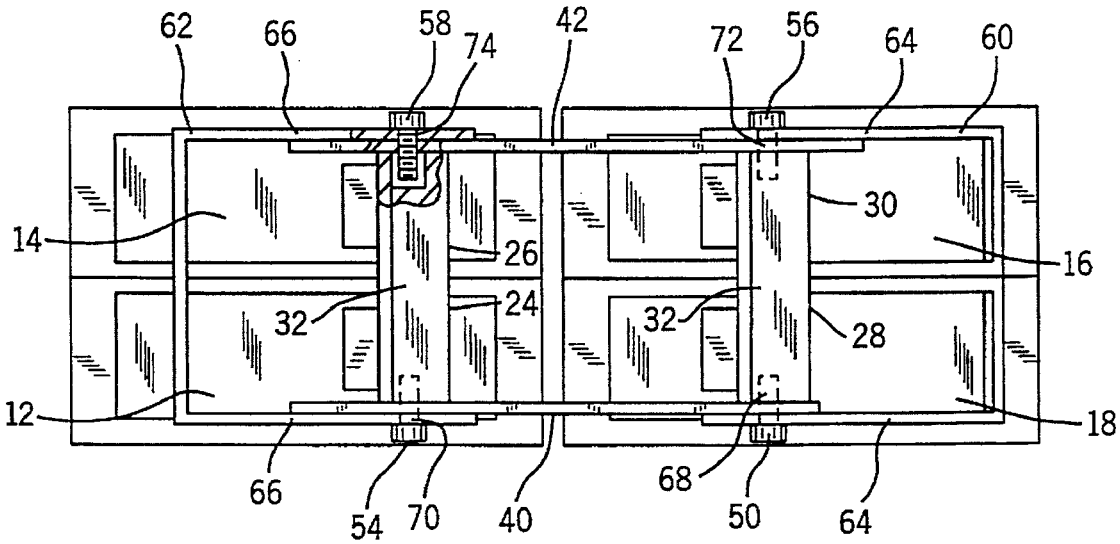
FIG. 10 is a top view of the linkage of the preferred embodiment including retainer brackets.

FIG. 10 illustrates link 42 having an aperture like 43 at one end and a slot like 44 at the other end. A third pin 56 passes through the aperture opposite 43 and is insertable in a bore formed on the one side of operating handle 30. A fourth pin 58 passes through the slot opposite 44 and is insertable in a bore formed on the one side of operating handle 26.

Figure 3:
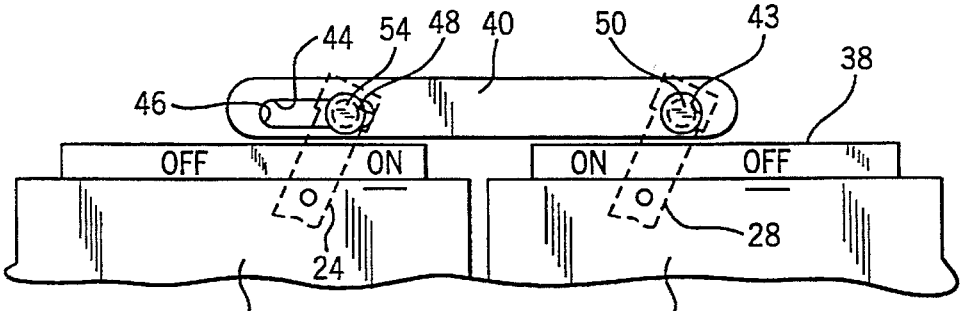
FIG. 3 is a partial sectional view taken on line 3—3 of FIG. 2.
Figure 4:
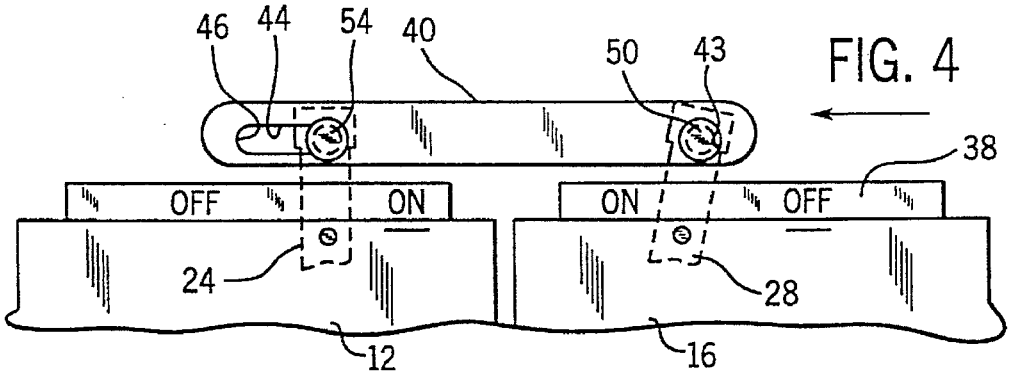
FIGS. 4–6 are sequential representations similar to FIG. 3 of the movement of the linkage during a utility power interruption.
Figure 5:
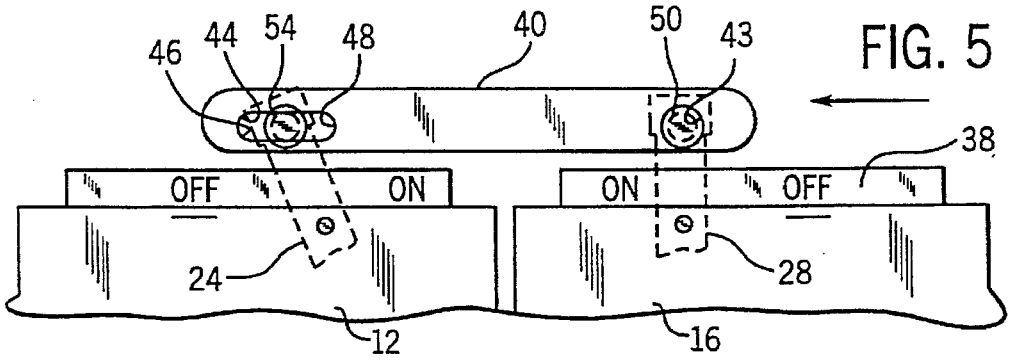
Figure 6:
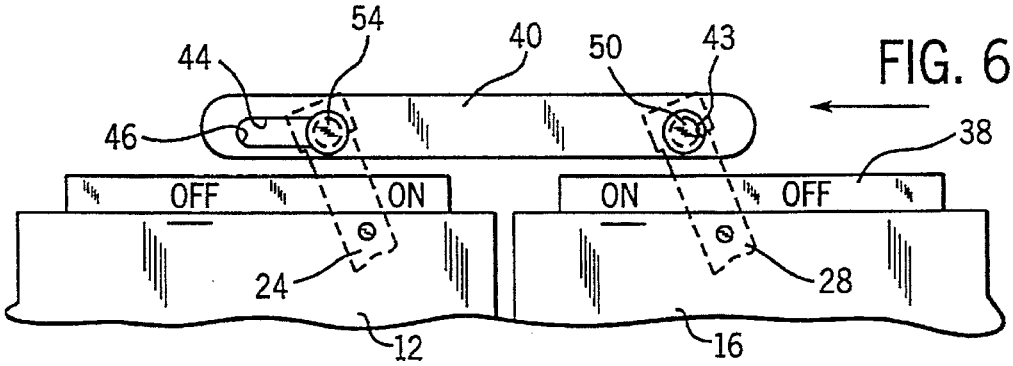

FIGS. 3–9 illustrate sequential representations of a switching operation occurring during a typical utility power interruption. In FIG. 3, switch 12 is in the ON position and switch 16 is in the OFF position under normal operating conditions when electrical utility power is uninterrupted and fully available. With switch 12 ON, the panel bus is fed from the electric utility. Switch 16 is OFF and no power can be transmitted either to or from the generator. FIG. 4 is the first of a sequence of drawings illustrating the events which typically occur during a utility power interruption. Switch 12 had been feeding utility power into the panel bus, but that power has now been interrupted. Power from a portable generator or other alternate source is now fed to switch 16 which is to be manually turned on. As operating handle 28 is moved towards the ON position, operating handle 24 is simultaneously moved towards the OFF position. FIG. 5 continues this progression, showing handle 24 after reaching its over-center position and then moving under the influence of a conventional biasing means, such as a spring, to its fully OFF position. The distance between the hole 43 and slot 44 in the link 40 is so spaced that the trailing edge of the slot 44 working against the pin 54 forces operating handle 24 over center to the OFF position before the operating handle 28 reaches the ON position. FIG. 6 shows the operating handle 28 subsequently moved over fully to the ON position. Power is now being fed from the alternate generator source to the panel bus. Switch 12 is OFF and portable generator power is unable to be fed to the utility supply. Likewise, if the utility power is restored, it will be unable to feed the panel bus. The circuit breakers 12 and 16 are to remain in this position as long as the utility power is unavailable.

Figure 7:
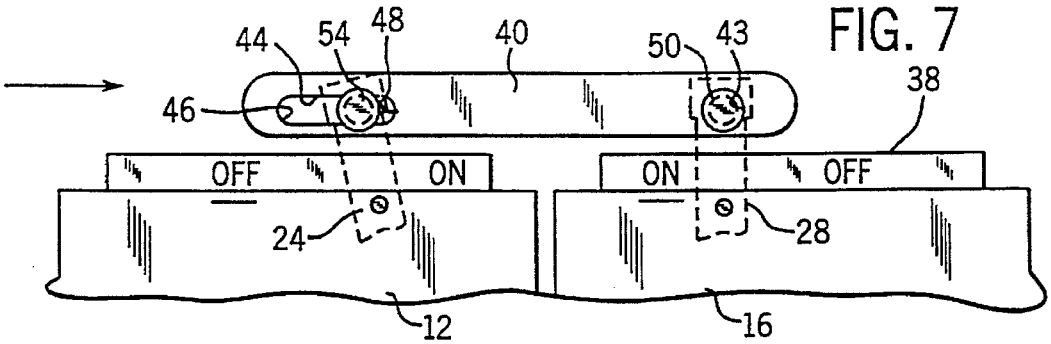
FIGS. 7–8 are sequential representations of the movement of the linkage during restoration of utility power.
Figure 8:
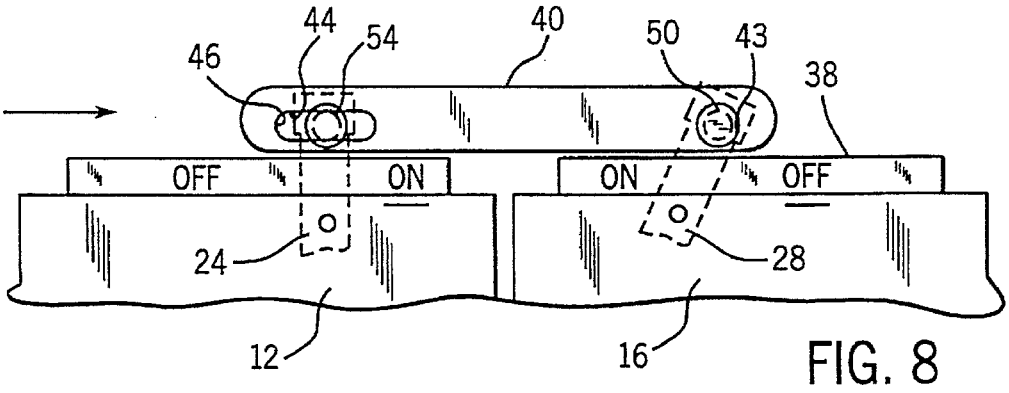
Figure 9:
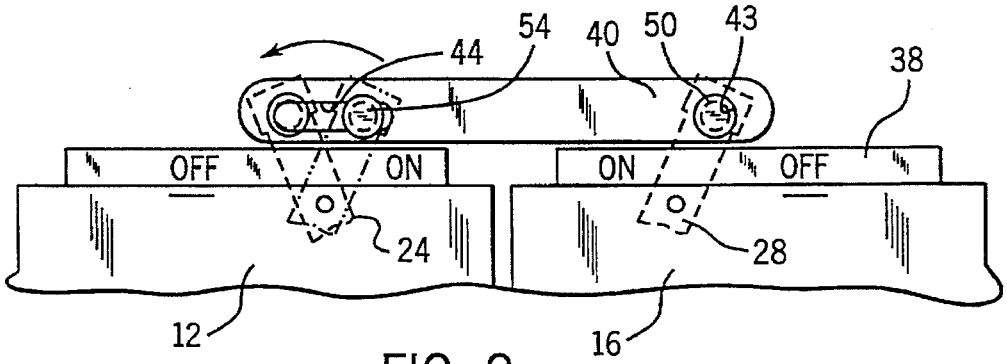
FIG. 9 is a representation of the linkage as returned to the position shown in FIG. 3 when utility power is fully restored, the linkage also showing the capability of opposed circuit breakers to be in the OFF position.

Upon restoration of utility power, the above sequence is reversed beginning with FIG. 7. As operating handle 24 is manually moved towards the ON position, the pin 54 engages the edge 48 of the slot 44 and thus moves operating handle 28 towards the OFF position. FIG. 8 shows further travel of the circuit breaker handles 24, 28 again in such a manner that handle 28 of switch 16 will be moved to its fully OFF position before handle 24 of switch 12 reaches its ON position. As shown in FIG. 9, further movement of operating handle 24 turns switch 12 ON, and the operating handles 24, 28 are restored to the original FIG. 3 positions. The sequence of events is ready to begin again at FIG. 3 at the next power outage. While this linkage arrangement prevents both circuit breakers from being ON at the same time, it does allow both breaker switches 12 and 16 to be OFF at the same time. Operating instructions do, in fact, recommend that one breaker be turned OFF before the other is turned ON, although this is not entirely necessary as the specific intent of the linkage arrangement described is to prevent both breakers from being ON simultaneously. FIG. 9 also illustrates both breakers in the OFF position.

A practical means of aligning and maintaining pins 50, 54, 56, 58 in the circuit breaker handles 24, 26, 28 and 30 is shown in FIG. 10. Each pin 50, 54, 56, 58 is inserted into an auxiliary set of U-shaped retainer brackets 60, 62 having parallel side arms 64, 66 disposed outside the links 40, 42. These pins 50, 54, 56, 58 protrude through the slots 44 and the holes 43 in the links 40, 42 and are screwed into threaded holes 68, 70, 72 and 74 formed in side arms 64, 66. The ends of the pins protrude into holes formed in the sides of the circuit breaker handles, 28, 24, 30, 26, respectively. Alternatively, pins 50, 54, 56, 58 may be riveted in position.

FIG. 11 illustrates a first alternative embodiment in which each of links 40', 42' is bent into a unitary U-shaped member. Although not expressly shown, it is intended that two shorter slots replace aperture 43 and slot 44 in the preferred embodiment. The operating principle of the linkage, however, remains unchanged. Retainer brackets 60', 62' are similar in structure and function to retainer brackets 60, 62.

FIGS. 12 and 13 illustrate a second alternative embodiment in which the linkage comprises a pair of two-piece links 40", 42", 40", 42" having overlapping end portions 76, 78, 80, 82. End portions 78, 80 are formed with aligned slots, shown at 84, through which a fifth pin 86 is staked. In this embodiment, the connection of each link to its respective switch handle is via a hole formed in the link, to impart direct movement to the links upon movement of the switch handles. Again, the arrangement of slots 84 is such that moving operating handle 24' towards an ON position will cause pin 86 to act against the trailing edges of slots 84 and move operating handle 28' to its OFF position before circuit breaker 12" is OFF. It should be understood that retainer brackets 60", 62" are not necessary in this embodiment if pin 86 is riveted solidly to brackets 76 and 82. In this version, pins 50' and 54' are then inserted directly into apertures in the links 40", 42". Likewise, it should further be understood that the slot 84 can be used simply for clearance in which case the point at which motion is transmitted is defined by the ends 76*a* and 82*a* of brackets 76 and 82 working against the surfaces 40*a*" and 42*a*".

It should be appreciated that the present invention provides a simplified circuit breaker linkage assembly employing a slotted connection to ensure that circuit breaker switches mounted in opposed orientation with their operating handles mechanically interconnected will be mutually constrained so that only one of the switches can be in the ON position at any one time.

While the invention has been described with reference to a preferred embodiment, those skilled in the art will appreciate that certain substitutions, alterations and omissions may be made without departing from the spirit thereof. For example, optional retaining walls 88, 90 (FIG. 2) are positioned parallel to links 40, 42 to prevent access to pins 50, 54, 56, 58. In addition, while the preferred embodiment illustrates the invention as used in connection with tandemly aligned circuit breakers, the invention is equally adaptable to single circuit breakers and triple aligned circuit breakers. Accordingly, the foregoing description is meant to be exemplary only, and should not be deemed limitative on the scope of the invention set forth with the following claims.

I claim:

1. An interlock for first and second tandemly aligned circuit breaker switches respectively having first and second external operating handles thereon oriented such that the operating handles are disposed away from each other when the switches are OFF and towards each other when the switches are ON, wherein each handle defines a pair of oppositely facing sides, said interlock comprising:

linkage means for applying a linear force between said first operating handle and said second operating handle, said linkage means comprising first and second link members, each link member being formed with at least one slot and being connected to said first operating handle such that said first link member is disposed adjacent one of said oppositely facing sides of said first handle and said second link member is disposed adjacent the other of said oppositely facing sides of said first handle and being connected to said second operating handle such that said first link member is disposed adjacent one of said oppositely facing sides of said second handle and said second link member is disposed adjacent the other of said oppositely facing sides of said second handle, wherein said link members are constructed and arranged such that pushing said first operating handle from an OFF to an ON position pushes said second operating handle from an ON to an OFF position.

2. The interlock of claim 1, wherein said switches each define an outward face, and wherein said linkage means lies in a plane perpendicular to the face of the circuit breaker switches.

3. The interlock of claim 1, wherein each of said first and second link members defines opposed ends and has an aperture at one end and wherein said slot is located at the other end, said slot having a leading edge and a trailing edge, there being a first pin passing through said aperture and insertable in a side of one of said operating handles, and a second pin passing through said slot and insertable in a side of the other of said operating handles.

4. The interlock of claim 3, wherein said aperture and said slot are spaced from each other such that said trailing edge of said slot acting against the pin extending therethrough forces said second operating handle over center to the OFF position before the first operating handle reaches the ON position.

5. The interlock of claim 1, wherein said linkage means comprises a pair of parallel, planar links.

6. The interlock of claim 1, including fastener means for connecting said links to said first operating handle and said second operating handle.

7. The interlock of claim 6, including retainer means disposed along side said links for holding and aligning said fastener means.

8. An interlock for first and second tandemly aligned circuit breaker switches respectively having first and second external operating handles thereon oriented such that the operating handles are disposed away from each other when the switches are OFF and towards each other when the switches are ON, said interlock comprising:

linkage means for applying a linear force between said first operating handle and said second operating handle, wherein said linkage means defines a pair of opposite end portions and a slot having a leading edge and a trailing edge associated with one of said end portions wherein one end portion of said linkage means is rigidly secured to said first operating handle and the other end portion of said linkage means is rigidly secured to said second operating handle, and including a pin associated with the other of said end portions and passing through and retained within said slot for interconnecting said first and second end portions, wherein said slot and said end portions are constructed and arranged such that pushing said first operating handle from an OFF to an ON position pushes said second operating handle from an ON to an OFF position.

9. The interlock of claim 8, wherein said linkage means comprises a pair of links having arm portions lying parallel to each other and mid portions lying adjacent each other.

10. An interlock for first, second, third and fourth circuit breaker switches having respective first, second, third and fourth external operating handles, the first and third switches being laterally aligned and the second and fourth switches being laterally aligned, the first and second switches being tandemly aligned and the third and fourth switches being tandemly aligned, the operating handles of the first and third switches being joined together and the operating handles of the second and fourth switches being joined together, the joined operating handles of the first and third switches being disposed away from the joined operating handles of the second and fourth switches when the switches are in the OFF position, the joined operating handles of the first and third switches being disposed towards the joined operating handles of the second and fourth switches when the switches are in the ON position, said interlock comprising:

a pair of parallel, elongated, planar links, each of said links having one end formed with an opening and connected in fixed relationship to a respective side of the joined first and third operating handles, each of said links further having another end formed with a slot and connected in slotted relationship to a respective side of the joined second and fourth handles such that pushing the operating handles of the joined first and third switches from an OFF to an ON position pushes the operating handles of the joined second and fourth switches from an ON to an OFF position;

each side of the joined first and third operating handles and the joined second and fourth operating handles being provided with a bore therein;

a pair of U-shaped retainer members, each retainer member having parallel side arms disposed outside of said links and formed with threaded apertures aligned respectively with said openings in said links and said bores in said sides of the joined first and third operating handles, and with said slots in said links and said bores in said sides of the joined second and fourth operating handles; and a first pin screwthreaded into a first one of said retainer member threaded apertures and passing through one of said openings into said bore on one side of the joined first and third operating handles, a second pin screwthreaded into a second one of said retainer member threaded apertures and passing through one of said slots into said bore on one side of said joined second and fourth operating handles, a third pin screwthreaded into a third one of said retainer member threaded apertures and passing through the other of said slots into said bore on the other side of the joined second and fourth operating handles and a fourth pin screwthreaded into a fourth one of said retainer member threaded apertures and passing through one of said openings on the other side of the joined first and third operating handles.

* * * * *